United States Patent [19]

Sun et al.

[11] 4,155,716

[45] May 22, 1979

[54] PROCESS FOR REMOVING SULFUR FROM COAL

[75] Inventors: Jui-Yuan Sun; Jin S. Yoo, both of South Holland; Emmett H. Burk, Jr., Glenwood, all of Ill.; George P. Masologites, Columbus, N.C.

[73] Assignee: Atlantic Richfield Company, Philadelphia, Pa.

[21] Appl. No.: 866,590

[22] Filed: Jan. 3, 1978

[51] Int. Cl.[2] ..... C10L 9/10; C10B 57/00

[52] U.S. Cl. ..... 44/1 R; 201/17

[58] Field of Search ..... 44/1 R, 4, 6, 16 A, 44/16 C, 16 E; 201/17

[56] References Cited

U.S. PATENT DOCUMENTS 1,668,643 5/1928 Hart ..... 44/16 E

FOREIGN PATENT DOCUMENTS 352444 7/1931 United Kingdom ..... 44/16 E

*Primary Examiner*—Carl Dees

*Attorney, Agent, or Firm*—John B. Goodman

[57] ABSTRACT

A process for reducing the sulfur content of coal comprising the steps of:

(1) contacting coal particles with a silicate selected from the group consisting of alkali metal silicates, alkaline earth metal silicates and mixtures thereof in an aqueous medium to reduce the sulfur content of the coal; and (2) recovering coal particles of reduced sulfur content.

15 Claims, No Drawings

PROCESS FOR REMOVING SULFUR FROM COAL

BACKGROUND OF THE INVENTION

1. Field of the Invention

The field of this invention relates to a process for reducing the sulfur content of coal.

2. Prior Art

The problem of air pollution due to the emission of sulfur oxides when sulfur-containing fuels are burned has received increasing attention in recent years. It is now widely recognized that sulfur oxides can be particularly harmful pollutants since they can combine with moisture to form corrosive acidic compositions which can be harmful and/or toxic to living organisms in very low concentrations.

Coal is an important fuel, and large amounts are burned in thermal generating plants primarily for conversion into electrical energy. One of the principal drawbacks in the use of coal as a fuel is that many coals contain amounts of sulfur which generate unacceptable amounts of sulfur oxides on burning. For example, coal combustion is by far the largest single source of sulfur dioxide pollution in the United States at present, and currently accounts for 60 to 65% of the total sulfur oxide emissions.

The sulfur content of coal, nearly all of which is emitted as sulfur oxides during combustion, is present in essentially two forms: inorganic, primarily metal pyrites, and organic sulfur. The inorganic sulfur compounds are mainly iron pyrites, with lesser amounts of other metal pyrites and metal sulfates. The organic sulfur may be in the form of thiols, disulfide, sulfides and thiophenes chemically associated with the coal structure itself. Depending on the particular coal, the sulfur content can be primarily in the form of either inorganic sulfur or organic sulfur. Distribution between the two forms varies widely among various coals. For example, both Appalachian and Eastern interior coals are known to be rich in pyritic and organic sulfur. Generally, the pyritic sulfur represents from about 25% to 70% of the total sulfur content in these coals.

Heretofore, it was recognized that it would be highly desirable to remove (or at least lower) the sulfur content of coal prior to combustion. In this regard, a number of processes have been suggested for reducing the inorganic (pyritic) portion of the sulfur in coal.

For example, it is known that at least some pyritic sulfur can be physically removed from coal by grinding the coal, and subjecting the ground coal to froth flotation or washing processes. While such processes can desirably remove some pyritic sulfur and ash from the coal, these processes are not fully satisfactory because a significant portion of the pyritic sulfur is not removed. Attempts to increase the portion of pyritic sulfur removed have not been successful because these processes are not sufficiently selective. Because the process is not sufficiently selective, attempts to increase pyrite removal can result in a large portion of coal being discarded along with ash and pyrite. Organic sulfur cannot be physically removed from coal.

There have also been suggestions heretofore to chemically remove pyritic sulfur from coal. For example, U.S. Pat. No. 3,768,988 to Meyers, issued Oct. 30, 1973, discloses a process for reducing the pyritic sulfur content of coal involving exposing coal particles to a solution of ferric chloride. The patent suggests that in this process ferric chloride reacts with pyritic sulfur to provide free sulfur according to the following reaction process:

$$2FeCl_3 + FeS_2 \rightarrow 3FeCl_2 + S$$

While this process is of interest for removing pyritic sulfur, a disadvantage of the process is that the liberated sulfur solids must then be separated from the coal solids. Processes involving froth flotation, vaporization and solvent extraction are proposed to separate the sulfur solids. All of these proposals, however, inherently represent a second discrete process step with its attendant problems and cost which must be employed to remove the sulfur from coal. In addition, this process is notably deficient in that it cannot remove organic sulfur from coal.

In another approach, U.S. Pat. No. 3,824,084 to Dillon issued July 16, 1974, discloses a process involving grinding coal containing pyritic sulfur in the presence of water to form a slurry, and then heating the slurry under pressure in the presence of oxygen. The patent discloses that under these conditions the pyritic sulfur (for example, $FeS_2$) can react to form ferrous sulfate and sulfuric acid which can further react to form ferric sulfate. The patent discloses that typical reaction equations for the process at the conditions specified are as follows:

$$FeS_2 + H_2O + 7/2O_2 \rightarrow FeSO_4 + H_2SO_4$$

$$2FeSO_4 + H_2SO_4 + 1/2O_2 \rightarrow Fe_2(SO_4)_3 + H_2O$$

These reaction equations indicate that in this particular process the pyritic sulfur content continues to be associated with teh iron as sulfate. Several factors detract from the desirability of this process. The oxidation of sulfur in the process does not proceed at a rapid rate, thereby limiting output for a given processing capacity. In addition, the oxidaton process is not highly selective such that considerable amounts of coal itself can be oxidized. This is undesirable, of course, since the amount and/or heating value of the coal recovered from the process is decreased.

Numerous other methods have been proposed for reducing the pyritic sulfur content of coal. For example, U.S. Pat. No. 3,938,966, to Kindig et al. issued Feb. 17, 1976, discloses treating coal with iron conbonyl to enhance the magnetic susceptibility of iron pyrites to permit removal with magnets.

In summary, while the problem of reducing the sulfur content of coal has received much attention, there still exists a present need for a practical method to more effectively reduce the sulfur content of coal.

SUMMARY OF THE INVENTION

This invention provides a practical method for more effectively reducing the sulfur content of coal. In summary, this invention involves a process for reducing the sulfur content of coal comprising the steps of:

(1) contacting coal particles with a silicate selected from the group consisting of alkali metal silicates, alkaline earth metal silicates and mixtures thereof in an aqueous medium to reduce the sulfur content of the coal; and (2) recovering coal particles of reduced sulfur content.

It has been discovered that contacting sulfur-containing coal with alkali metal silicate, alkaline earth metal silicate and mixtures thereof in an aqueous medium, can very effectively remove pyritic sulfur and some organic sulfur from coal. An advantage of the process is that significant sulfur reduction is obtained without significant oxidation or other adverse modification of the coal substrate. The desirable result is that sulfur reduction is obtained without the amount and/or heating value of the coal being significantly decreased. Another advantage of the process is that silicates are readily available and waste disposal problems are minimal.

DETAILED DESCRIPTION OF THE INVENTION AND ITS PREFERRED EMBODIMENTS

In its broad aspect, this invention provides a method for reducing the sulfur content of coal by a process comprising the steps of:

(1) contacting coal particles with a silicate selected form the group consisting of alkali metal silicate, alkaline earth metal silicates and mixtures thereof in an aqueous medium to reduce the sulfur content of the coal; and (2) recovering coal particles of reduced sulfur content.

The novel process of this invention can substantially reduce the pyritic sulfur content of coal employing readily available alkali metal and alkaline earth metal silicate materials. In addition, the process does not produce by-products which present substantial disposal problems.

Suitable coals which can be employed in the process of this invention include brown coal, lignite, subbituminous, bituminous (high volatile, medium volatile, and low volatile), semi-anthracite, and anthracite. Regardless of the rank of the feed coal, significant pyritic removal can be achieved by the process of this invention. Metallurgical coals, and coals which can be processed to metallurgical coals, containing sulfur in too high a content, can be particularly benefited by the process of this invention.

In the first step of the process of this invention, coal particles are contacted with an aqueous solution of alkali metal silicate, alkaline earth metal silicate or mixtures thereof in an aqueous medium.

The coal particles employed in this invention can be provided by a variety of known processes, for example, grinding or crushing.

The particle size of the coal can vary over wide ranges. In general, the particles should be sufficiently small to enhance contacting with the aqueous medium. For instance, the coal may have an average article size of one-eighth inch in diameter or larger in some instances, and as small as minus 200 mesh (Tyler Screen) or smaller. The rate of sulfur removal is faster the smaller the particle, but this advantage must be weighed against problems associated with obtaining and handling small particles. A very suitable particle size is often minus 5 mesh, preferably minus 18 mesh on 100 mesh as less effort is required for grinding and handling and yet the particles are sufficiently small to achieve an effective rate of sulfur removal.

The coal particles can be contacted with the alkali metal and/or alkaline earth metal silicate in an aqueous medium by forming a mixture of the coal particles, silicate and water. The mixture can be formed, for example, by grinding coal in the presence of water and adding a suitable amount of silicate or an aqueous mix of silicate and water can be added to coal particles of a suitable size or suitable alkali metal and/or alkaline earth metal salts, and a suitable silicate precursor can be added to an aqueous slurry of coal particles under conditions such that the silicate is generated in situ. Preferably, the mixture contains from about 5 to about 75%, by weight of the mixture, coal particles and more preferably from about 10 to about 60%, by weight of the mixture, coal particles.

The most suitable amount of silicate employed depends upon the pyrite content of the coal. It is generally convenient to employ aqueous medium containing 0.1% to 20%, and preferably 2% to 10%, by weight, silicate.

Suitable alkali metal silicates are potassium silicates and sodium silicates. Alkali metal silicates preferred for use in this invention are compounds having $SiO_2$:$M_2O$ formula weight ratios up to 4:1, wherein M represents an alkali metal, for example, K or Na.

Alkali metal silicate products having silica-to-alkali weight ratios ($SiO_2$:$M_2O$) up to about 2 are water soluble, whereas those in which the ratio is above about 2.5 exhibit less water solubility, but can be dissolved by steam under pressure to provide viscous aqueous solutions or dispersions.

The most preferred alkali metal silicates are the readily available potassium and sodium silicates having an $SiO_2$:$M_2O$ formula weight ratios up to 2:1.

As is well known, alkali metal silicates often form hydrates. As used herein, the term alkali metal silicate includes corresponding alkali metal silicate hydrates. Examples of specific alkali metal silicates are anhydrous $Na_2SiO_3$ (sodium metasilicate), $Na_2Si_2O_5$ (sodium disilicate), $Na_4SiO_4$ (sodium orthosilicate), $Na_6Si_2O_7$ (sodium pyrosilicate) and hydrates, for example, $Na_2SiO_3 \cdot nH_2O$ (n=5,6,8 and 9), $Na_2SiO_4O_9 \cdot 7H_2O$ and $Na_3HSiO_4 \cdot 5H_2O$.

Typically alkali metal silicates can be prepared by fusion of sand with an appropriate alkali metal carbonate, the composition of the product obtained being determined by the ration of the reactants. It is contemplated within the scope of the invention that the silicates can be added directly or generated in situ using a silicate-forming precursor, in the course of carrying out the process of this invention for desulfurizing coal. It will generally be desirable that the pH of the aqueous solution be above pH 10. In a preferred aspect of this invention, the pH is from about 12 to 14, and more preferably from aout 12.5 to 13.5. Under these preferred pH conditions and preferred elevated temperature conditions, the alkali metal silicate can be formed in situ using a silicate precursor and a suitable alkaline basic material for example, alkali metal hydroxides and carbonates.

Suitable alkaline earth metal silicates are calcium silicate and magnesium silicate. As is well known, alkaline earth metal silicates often form hydrates, and as used herein, the term alkaline earth metal silicate includes alkaline earth metal silicte hydrates.

Many methods are known for synthetically preparing alkaline earth metal silicates. For example, a water soluble alkaline earth metal salt can be added to a water solution of alkali metal silicate. With respect to calcium silicate, for example, calcium nitrate can be added to an alkali metal silicate (such as disclosed hereinbefore) solution to obtain calcium silicate. The resulting Ca:Si ratio of the product is then controlled largely by the $M_2O/SiO_2$ ratio in the sodium silicate solution. These calcium silicates exhibit very limited water solubility, yet they are useful in the process.

If the process of this invention, mixtures (generally formed in situ) of alkali metal and alkaline earth silicates can be preferred if coal products not having a high sodium content in the ash portion of the coal are desired. In a preferred practice of this invention involving a pH of from 12 to 14 and elevated temperature, a mixed alkali metal/alkaline earth metal silicate system can be formed in situ by adding alkali metal hydroxide, silica and lime to an aqueous slurry of coal particles with the result that alkali metal and alkaline earth metal silicates are generated in the course of the process. Alternative materials which provide the same or similar results could, of course, be employed.

As mentioned hereinbefore, elevated temperatures can be desirably employed. Elevated temperature can desirably accelerate the removal of sulfur from coal in the process. For example, temperatures of from about 100° C. to 500° C. preferably from about 150° to 400° C., and more preferably from about 175° to about 350° C., can be suitably employed. Under these reaction conditions, at least a portion of the sulfur in the coal, primarily pyritic sulfur can be rapidly removed without significant adverse affect on the coal substrate.

Elevated pressures can also desirably be employed to accelerate the process. For example, pressures of from 25 psig. to 1500 psig. or higher can be employed. At temperatures above 100° C. the autogenuous vapor pressure of water will, of course, provide elevated pressure and suitable equipment to contain such elevated pressure must be employed. A preferred pressure range is from 25 psig. to 500 psig.

The coal is contacted for a period of time sufficient to remove a portion of the sulfur in the coal. The optimum time will depend upon the particular reaction conditions and the particular coal employed. Generally, a time period in the range of from about 5 minutes to 5 hours, or more, can be satisfactorily employed. Preferably, a time period of from 10 minutes to 2 hours is employed. During this time, agitation can be desirably employed to enhance contacting. Known mechanical mixers, for example, can be employed.

The process step whereby the sulfur-containing coal is contacted with silicate and aqueous medium may be carried out in any conventional manner, e.g., batchwise, semi-batchwise or continuously. Conventional equipment, such as, stirred tanks, agitated or stirred autoclaves can be employed in performing this contacting step.

This contacting step causes at least a portion of the sulfur in the sulfur-containing coal to form sulfur bearing compounds which can be separated from the coal, preferably as water soluble compounds.

It is a desirable aspect of the invention that no major by-product of the process of the invention presents a significant disposal problem.

After contacting sulfur-containing coal with alkali metal silicate and/or alkaline earth metal silicate in accordance with this invention, coal of reduced sulfur content can be separated from the aqueous medium. This separation may be performed using conventional procedures, such as filtering with bar sieves or screens, or centrifuging and can be performed on a batch basis or continuously.

It has been found that successive treatments of the coal according to the process of this invention can often provide further reduction of pyritic sulfur. Accordingly, successive treatments, or continuous counter-current treatment equivalent to successive batch treatments, can represent a preferred practice of this invention.

All parts, percentages and proportion herein are on a weight basis unless otherwise specified.

The following examples illustrate more clearly the process of the present invention. However, these illustrations are not to be interpreted as specific limitations on the invention.

EXAMPLE I

A sample of Coal (Somerset) was ground and screened to provide a quantity of coal having a particle size of 100 0 mesh. This feed coal had the following analysis on a dry, ash-free basis:

| Component | Percent by Weight |
|---|---|
| Sulfate Sulfur | 0.18 |
| Pyritic Sulfur | 2.80 |
| Organic Sulfur | 0.97 |
| Total Sulfur | 3.95 |
| Ash | 15.5 |

The coal was treated in the following manner to reduce tha sulfur content in the coal. A slurry of this coal and an aqueous solution containing a 3.7% by weight sodium metasilicate ($Na_2SiO_3$) formed. The resulting slurry contained 9%, by weight, coal. This slurry was charged to an autoclave. The autoclave was sealed and then heated to 250° C. The contents were held under these conditions for one hour. The autoclave was then cooled. The contents of the autoclave were then filtered to separate the coal and the aqueous solution. The separated coal product was thoroughly washed with warm water, and dried.

The resulting coal product had the following analysis on a dry, ash-free basis:

| Component | Percent by Weight |
|---|---|
| Sulfate Sulfur | 0.01 |
| Pyritic Sulfur | 1.18 |
| Organic Sulfur | 0.70 |
| Total Sulfur | 1.89 |
| Ash | 22.6 |

When compared to the feed coal on a dry, ash-free basis, the coal product exhibited a 52% reduction in total sulfur, a 58% reduction in pyritic sulfur and a 28% reduction in organic sulfur. (As used herein, "organic sulfur" includes elemental sulfur).

EXAMPLES II AND III

Another sample of Somerset coal was selected as a feed coal. This feed coal was subjected to the same process employed in Example I except that higher temperatures were employed. The sulfur content of the feed coal and coal products after treatment are presented in Table I.

TABLE I

| Ex. No. | Temp. °C. | Time, Hr. | $Na_2SiO_3$ % | Ash | % By Weight Sulfur (Dry Ash-Free Basis) Total | Sulfate | Pyritic | Organic | % Sulfur Removal Total | Pyrite | Organic |
|---|---|---|---|---|---|---|---|---|---|---|---|
| | Somerset Feed Coal | | | 14.8 | 3.77 | 0.19 | 2.72 | 0.86 | | | |
| II | 280 | 1 | 3.7 | 22.5 | 1.34 | <0.01 | 0.65 | 0.75 | 64 | 76 | 19 |
| III | 300 | 1 | 3.7 | 22.5 | 1.35 | 0.01 | 0.74 | 0.61 | 64 | 73 | 29 |

As can be seen in Table I, the process of the invention provides a coal product substantially reduced in sulfur content.

The filtrate from Example II was analyzed, and it was found that substantially all the sulfur removed from the coal was in the filtrate. On acidification, this filtrate yielded elemental sulfur and hydrogen sulfide. Hydrogen sulfide can be conveniently converted to elemental sulfur employing conventional processes, e.g., Claus processes, and elemental sulfur can be recovered using known methods. After the sulfur content is removed, the filtrate can be returned to the process for further use.

EXAMPLE IV

When in Example I, one or more of the following alkali metal silicates are employed instead of sodium metasilicate the same or similar results are obtained in that a coal product reduced in sulfur content is obtained: sodium disilicate, sodium orthosilicate and sodium pyrosilicate.

EXAMPLE V

The following example illustrates that a coal sample treated successively with alkali metal silicate can provide improved results as compared with a once-through treatment under the same conditions and time.

A sample of coal (Kingwood) was ground and screened to provide a quantity of coal having a particle size of 100×0 mesh. A slurry of this coal and an aqueous containing 3.7%, by weight, sodium metasilicate was formed. This slurry was charged to an autoclave. The autoclave was sealed and then heated to 250° C. The contents of the autoclave were held under these conditions for 15 minutes. The autoclave was then cooled and the contents filtered to separate the coal and the aqueous solution. The coal was subjected to this same treatment two more times. The composition of the feed coal, and the composition of the coal after the second and third treatment are given in Table II below.

TABLE II

| Treatment | Temp. °C. | Time, min. | $Na_2SiO_3$% | Ash | % By Weight, Sulfur (Dry Ash Free Basis) Total | Sulfate | Pyritic | Organic | % Sulfur Removal Total | Pyritic | Organic |
|---|---|---|---|---|---|---|---|---|---|---|---|
| | Kingwood Feed Coal | | | 12.4 | 3.11 | 0.25 | 1.93 | 0.93 | | | |
| First | | | | | No Analysis Made | | | | | | |
| Second | 250 | 15 each | 3.7 | 19.0 | 1.35 | 0.01 | 0.69 | 0.65 | 57 | 64 | 30 |
| Third | 250 | 15 | 3.7 | 19.1 | 1.01 | 0.06 | 0.21 | 0.74 | 68 | 89 | 20 |

While this invention has been described with respect to various specific examples and embodiments, it is to be understood that the invention is not limited thereto and that it can be variously practiced within the scope of the following claims.

What is claimed is:

1. A process for reducing the sulfur content of coal comprising the steps of:

(1) contacting coal particles with a silicate selected from the group consisting of alkali metal silicates, alkaline earth metal silicates and mixtures thereof in an aqueous medium to reduce the sulfur content of the coal; and (2) recovering coal particles of reduced sulfur content.

2. The process of claim 1 wherein the contacting occurs at elevated temperature.

3. The process of claim 2 wherein the elevated temperature is a temperature of from about 100° C. to 500° C.

4. The process of claim 2 wherein the coal is contacted for a period of 5 minutes to 5 hours.

5. The process of claim 4 wherein the silicate is an alkali metal silicate.

6. The process of claim 4 wherein the silicate is an alkaline earth metal silicate.

7. The process of claim 4 wherein the silicate is a mixture of alkali and akaline earth metal silicates.

8. The process of claim 4 wherein the temperature is from about 150° C. to 400° C.

9. The process of claim 4 wherein the aqueous medium contains from about 0.1% to 20%, by weight, silicate.

10. The process of claim 5 wherein the alkali metal silicate is selected from the group consisting of potassium silicate, sodium silicate and mixtures thereof.

11. The process of claim 6 wherein the alkaline earth metal silicate is selected from the group consisting of calcium silicate and magnesium silicate.

12. The process of claim 10 wherein the alkali metal silicate is sodium silicate.

13. The process of claim 12 wherein the sodium silicate is selected from the group consisting of sodium metasilicates, sodium disilicates, sodium orthosilicates and sodium pyrosilicates.

14. The process of claim 13 wherein the sodium silicate is sodium metasilicate.

15. The process of claim 1 wherein steps (1) and (2) are successively repeated.

* * * * *